United States Patent [19]

Hageman

[11] Patent Number: 4,460,226

[45] Date of Patent: Jul. 17, 1984

[54] ELECTRICAL CONNECTOR FOR LUMINOUS DISPLAYS

[75] Inventor: Neil Hageman, Chico, Calif.

[73] Assignee: Hage Connectors, Inc., Chico, Calif.

[21] Appl. No.: 473,579

[22] Filed: Mar. 9, 1983

Related U.S. Application Data

[63] Continuation of Ser. No. 202,193, Oct. 30, 1980, abandoned.

[51] Int. Cl.[3] ..... H01R 33/08

[52] U.S. Cl. ..... 339/55; 40/545; 339/50 R

[58] Field of Search ..... 339/50–57; 40/545; 362/217

[56] References Cited

U.S. PATENT DOCUMENTS

| | | | |
|---|---|---|---|
| 1,933,344 | 10/1933 | Schouwstra | 339/55 |
| 2,011,178 | 8/1935 | Komm et al. | 339/50 S |
| 2,306,686 | 12/1942 | Chegwidden | 339/55 |
| 2,314,038 | 3/1943 | Elting | 339/57 |

FOREIGN PATENT DOCUMENTS

| | | | |
|---|---|---|---|
| 330036 | 6/1930 | United Kingdom | 40/545 |
| 436812 | 10/1935 | United Kingdom | 339/50 R |

OTHER PUBLICATIONS

P-K Peterson Neon Electrode Receptacle and Accessories, Signs of the Times, Jul. 1980, p. 83.

*Primary Examiner*—Neil Abrams

*Attorney, Agent, or Firm*—Manfred M. Warren; Robert B. Chickering; Glen R. Grunewald

[57] ABSTRACT

An electrical connector is disclosed for luminous displays having one or more gaseous electric discharge tubes provided with electrode contact bearing ends and disposed within a letter or sign housing mounted at the exterior side of a building wall. An electrical housing for a high tension transformer and electrical raceway is mounted at the interior side of the wall and rigid metal conduits extend through the wall and have their opposite ends secured to and in communication with the interiors of the letter and transformer housings for accommodation of a high tension conductor. The improvement of the present invention includes a dielectric conduit for the high voltage conductor and having a length and dimension for removable telescopic mounting in and support by one of the rigid metal conduits and having a right angularly related open ended dielectric receptacle or socket at its outboard end to telescopically receive one of the electric tube ends so as to support the display tube substantially parallel to a midplane of the letter housing, the dielectric conduit and the metal conduit cofunctioning to position and support the display tube in the letter housing substantially parallel to the center plane thereof.

4 Claims, 4 Drawing Figures

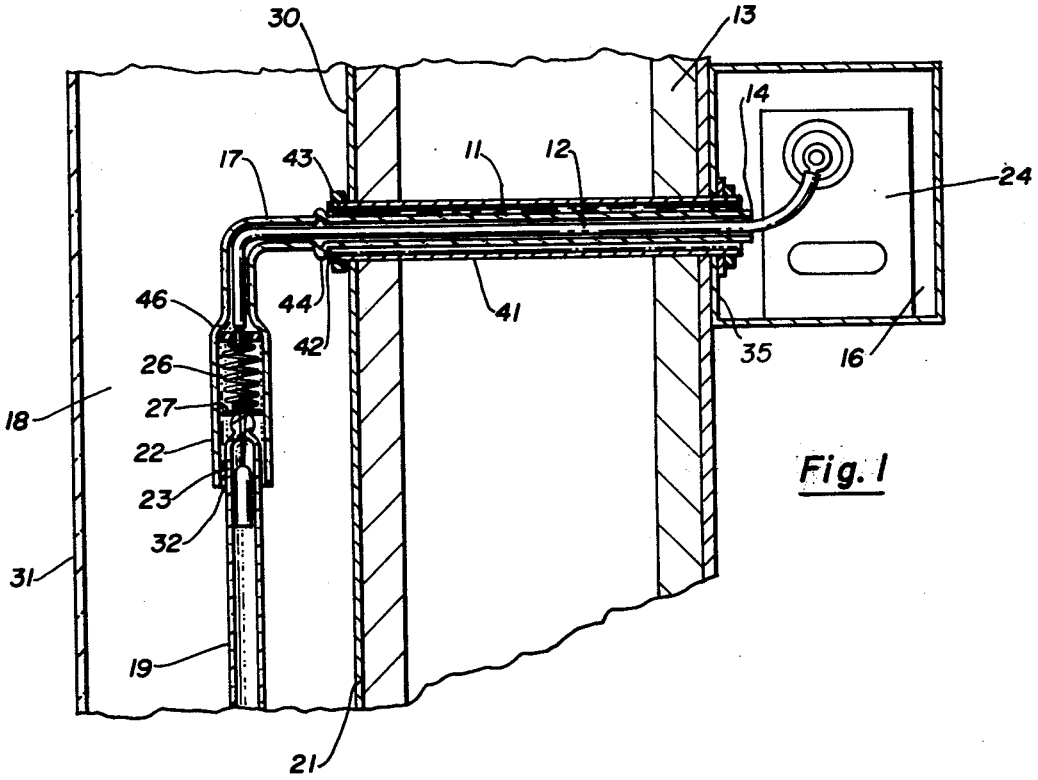
Fig. 1
Fig. 2
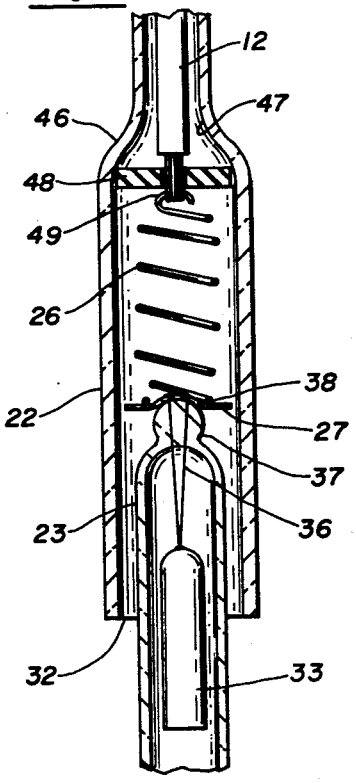

ELECTRICAL CONNECTOR FOR LUMINOUS DISPLAYS

CROSS-REFERENCE TO RELATED APPLICATION

This application is a continuation of application Ser. No. 202,193, filed Oct. 30, 1980 for ELECTRICAL CONNECTOR FOR GASEOUS ELECTRIC DISCHARGE TUBE and now abandoned.

BACKGROUND OF THE INVENTION

1. Field of Invention

The invention relates to electrical connectors used in the energizing of advertising signs and displays e.g., neon signs, and more particularly to the manner of connection of the high tension electrical conductors to the electrodes conventionally mounted at the ends of the gas filled electric discharged tubes.

2. Description of Prior Art

Typically, the display tubes are mounted in a display or sign housing appropriately supported at the exterior of a building, and electrical connections are made through a length of rigid metal conduit which extends from the housing through the adjacent building wall to an electric raceway, box or the like, at the interior side of the wall. Electrodes are mounted in the opposite ends of lengths of gas-filled tubing and the electrodes have pig tail wires connected thereto and sealed in the adjacent end wall of the tube from which the wires extend for connection to the ends of the high tension conductors which are brought into the housing through the metal conduit. It has been common practice to effect the electrical connections by merely twisting together the pigtail wires and the ends of the high tension conductors.

Relatively high voltages are employed to excite the gas-filled tubes and hence it is highly desirable to avoid the requirement for manual engagement of the connecting parts and the attendant electric shock hazard.

A special connector, see page 82 of September, 1981, issue of magazine entitled Signs of The Times, published by Signs of The Times Publishing, Co., 407 Gilbert Avenue, Cincinnati, Ohio 45202, known as the P-K connector has been developed to avoid the potential shock hazard described. This connector comprises an enlarged dielectric tubular receptacle which is mounted within a cylindrical metal housing and which is adapted for mounting through the building wall on which the sign is mounted. The internal diameter of the dielectric receptacle is sufficiently large to telescopically receive an electrode bearing end of the neon tube which is fashioned to extend from the sign housing into the interior of the dielectric receptacle. An electric constant within the receptacle is connected to the end of a high tension conductor and makes contact with an electrode connected contact member carried at the end of the inserted tube. Consequently, the electrical connection to the tube is effected within the interior of the dielectric receptacle away from possible manual engagement, and the connection is made automatically upon insertion of the tube end into the receptacle. The P-K connector has two principal disadvantages. One, the connector is of large size and requires the boring through the wall of relatively large holes for each of the high tension connectors. Secondly, the electrical connection is effected outside of the conventional sign housing and requires special fashioning of the electrode bearing ends of the sign tubes to provide for the extension of such ends at right angles through the normally back wall of the sign housing, outside of the housing, and into the wall mounted receptacles. Of course this glass letter end is quite fragile and needs to be carefully protected in handling, crating, storage and shipment. Also due to the projecting of these tube ends, the overall width of the unit extends well beyond the width of the letter of sign housing. Typically, a letter housing has a depth of about 5 inches and the required projection of the frangible glass tube ends from the housing is also in the range of about 4 to 5 inches making the overall width of the unit some 9 to 10 inches and requiring most careful support for the frangible tube ends. The letter housing thus becomes more awkward and difficult to handle than a simple compact letter housing which workmen in this field are used to handling and requires oversize crates for packaging, handling, storage and shipping. Since only one electrical connection can be made for each P-K connector, a minimum of two such large well openings and P-K connectors are required for each separately energized character or portion of the sign.

SUMMARY OF THE INVENTION

The connector of the present invention provides for the automatic electrical connection of the tube electrodes and the high tension conductors in a protected, enclosed, manually inaccesible, chamber thus avoiding the necessity of manual handling and connecting of the high tension conductors and electrode leads and the attendant shock hazard.

Another object and feature of the present invention is that the sign or display may be manufactured and installed completely self-contained with all the electrical connections made within the interior of the sign housing and with no portion of the neon tube required to project out of the sign housing.

A further object of the present invention is to provide an electrical connector of the character described in which all of the parts of the sign, tubes and connectors can be easily fitted within and receive the protective enclosure of the sign housing for compact storage and easy and protective enclosure for handling and shipping, with the several parts designed for rapid and easy assemble in the field. All of the parts fit well within the sign housing itself and no fragile parts are required to project from the housing at any time.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

BRIEF DESCRIPTION OF THE DRAWINGS

FIG. 1 is a cross-sectional view of an electrical connector constructed in accordance with the present invention and shown in operative position with respect to a wall-mounted sign.

FIG. 2 is an enlarged cross-sectional view of a portion of the connector.

DETAILED DESCRIPTION OF THE INVENTION

The electrical connector of the present invention is adapted for use in combination with a building wall 13, a metal conduit 41 extending through the wall and terminated at and fastened to a letter or sign housing 18 at the outside 21 of the wall and to the high voltage conductor housing 16, typically a raceway containing high voltage transformer 24, at the inside of the wall, and a high voltage conductor 12 extending between housings 16 and 18. The present connector comprises briefly a dielectric conduit 11 dimensioned for receipt of the high voltage conductor 12 and for telescopic insertion into and removal from metal conduit 41; a right angularly related receptacle or socket 22 mounted at the normally conducted end 17 of the dielectric conduit and being connected to conductor 12 and dimensioned for receipt of an electrode bearing end 23 of a gaseous discharge tube 19 forming the letter or other display of the sign. Due to this right angled connection of receptacle 22, the dielectric conduit and its socket or receptacle and tube may be assembled outside of letter housing 18 and then moved as a unit into the letter housing with the dielectric conduit telescopically inserted in the metal conduit for positioning and supporting tube 19 in the letter housing substantially parallel to the center plane thereof. As will be observed, the open ended dielectric receptacle 22 is in communication with conduit 11 and is dimensioned to telescopically receive the end 23 of tube 19. A contact spring 26 is mounted in receptacle 22 and is adapted for connection to the high voltage electrical conductor 12 and is positioned for engagement with an electric contact 27 carried by tube end 23 upon insertion of the latter into receptacle 22. Conductor 12 will typically extend through conduit 41 from a transformer 24 in raceway 16.

The present connector is particularly suited for use with luminous displays in which individual letter or characters are contained within a housing, usually metal, quite shallow in depth, but sufficient to contain the tube display medially therein, and are customarily fitted with transparent face 31, typically translucent plastic, such as plexiglass or the like. Accordingly, the plane of tube 19 and of its electrode bearing end 23 will normally be parallel to the interior plane of the housing parallel to rear wall 30 of the sign housing. To accommodate this disposition of the tube end, receptacle 22 is here disposed substantially perpendicular to the longitudinal axis of conduit 11. In this manner, tube end 23 may be readily slipped telescopically into the open end 32 of receptacle 22. The standard tube end 23 contains an electrode 33 having pig tail wires 36 brought out through a sealed end 37 of the tube. To accommodate the tube to the connector of the present invention, a flat disk-like contact or button 27 is fastened to the outer ends of wires 36 and are supported by the latter exteriorly of tube end 37 in the position for full face-to-face engagement with the adjacent end 38 of spring 26.

As will be observed from FIG. 1, metal conduit 41 extends completely through wall 13 and through the attached wall 30 of the sign housing and the abutting wall 35 of the transformer housing or raceway 16 and may be fixed in place by conventional conduit nuts 43 placing the interiors of the two housings in communication. Preferably dielectric conduit 11 is provided with means, here an integral collar 44, which will abut the outer end 42 of the metal conduit to properly position receptacle 22 and tube 19 in the housing. The length of conduit 11 is optional and may extend only partially into conduit 41, rather than all the way through as here illustrated, the cofunctioning of the dielectric conduit and the metal conduit being to permit the telescopic insertion and withdrawal of the ceramic conduit and it secure support within the metal conduit and at the same time to position the sign tube 19 medially within the sign housing and substantially parallel to the center plane thereof. The structure illustrated in FIG. 1 is for the connection of one end 23 of tube 19, the structure being of course repeated at the opposite end of the tube. Thus, it is common practice to mount the gaseous discharge tube 19 in a pair of connectors as illustrated in FIG. 1, i.e., one connector at each end of the tube. Most conveniently the tube and its two spaced end connectors are assembled and then the ceramic tube portions of the connectors are telescopically inserted into prepositioned metal conduits 41 as above described so as to move the tube, letter, or character 19 into proper position within the sign housing as above described.

Receptacle 22 here comprises a relatively enlarged elongated tubular part forming an enlarged extension of conduit 11. Both parts may be formed of glass tubing coaxially fused together in a connecting portion 46 providing an interior shoulder 47 at the base of the receptacle. A member 48 is adapted for connection to conductor 12 and spring 26 and for seating on shoulder 47 to position and properly support spring 26 within the interior of the receptacle. Member 48 may be a washer-like disk having a central opening therein for threading onto the conductor at the point where it is connected to the adjacent end 49 of the spring. Preferably, and as here shown, spring 26 comprises an axially compressible wire helix having spirally wound reduced ends 38 and 49 for bearing on contact 27 and on support member 48. The distal end of conductor 12 may be extended through the opening of member 48 and crimped or otherwise fastened to spring end 49, whereupon conductor 12 may be pulled back so as to seat member 48 on shoulder 47.

What is claimed is:

1. In combination with a building wall, a metal conduit therethrough terminated at and fastened to a letter housing at the outside of said wall and to a high voltage conductor housing at the inside of said wall and a high voltage pliable, wire-like, conductor extending between said housings;

a rigid dielectric conduit dimensioned for receipt by insertion therethrough of said high voltage conductor and for telescopic insertion into and removal from said metal conduit;

a right angularly related socket mounted at the normally outboard end of said dielectric conduit and being connected to said conductor, and dimensioned for receipt of an electrode bearing end of a gaseous discharge tube into electrical connection with said conductor; and said dielectric conduit and socket and tube end being formed for assembly outside of said letter housing and for straight line telescopic insertion of said dielectric conduit into said metal conduit, said dielectric conduit and said metal conduit cofunctioning to position and support said tube in said letter housing substantially parallel to the center plane thereof.

2. An electrical connector for luminous displays having a gaseous electric discharge tube having an electrode contact bearing end and disposed within a letter housing mounted at the exterior side of a building wall, an electrical housing and high-tension transformer mounted therein at the interior side of said wall, a length of rigid metal conduit extending through said wall and having its opposite ends secured to and in communication with the interiors of said letter and transformer housings, and a high voltage pliable wire-like conductor extending between said transformer and letter housing through said metal conduit the improvement comprising:

a rigid dielectric conduit dimensioned to receive said high-voltage conductor and having a length and dimension for removable telescopic mounting in and support by said rigid metal conduit and having an open-ended dielectric receptacle mounted on its normally outboard end for positioning of said receptacle interiorly of said letter housing, said receptacle being dimensioned to telescopically receive the electrode contact bearing end of said tube, said receptacle having its tube-receiving axis substantially perpendicular to the longitudinal axis of said dielectric conduit and substantially parallel to the typical plane of orientation of said tube within said letter housing;

a contact spring mounted in said receptacle and adapted for connection to said electric conductor and positioned for engagement with said contact bearing end of said tube and upon insertion of the latter into said receptacle; and the foregoing parts being structured to permit insertion of said tube end into said receptacle outside of said letter housing and the conjoint movement of the assembled dielectric conduit and receptacle and discharge tube into said letter housing and straight line telescopic insertion of said dielectric conduit into said rigid metal conduit, said dielectric conduit and said metal conduit cofunctioning to support said assembled receptacle and discharge tube end in said letter housing and to position said tube substantially parallel to the center plane of said letter housing.

3. The structure of claim 2, and means on said dielectric conduit engageable with said rigid metal conduit for indexing the location of said receptacle and discharge tube end in said letter housing.

4. The method of assembly of a gaseous electric discharge tube having electrode contact bearing ends in a letter housing secured to the exterior of a building wall by substantially parallel rigid metal conduits extending through said wall and secured to a high voltage housing at the inside of said wall and a high voltage pliable wire-like conductor extending between said housings through said conduits;

inserting said tube ends into sockets and into engagement with electric contacts therein outside of said letter housing, said contacts being connected to said high voltage conductors mounted in and extending through rigid dielectric conduits connected at substantially right angles to said sockets and being dimensioned for straight line telescopic insertion into and withdrawal from said metal conduits;

positioning said tube and assembled sockets with said dielectric conduits in registration with said metal conduits; and inserting said dielectric conduits into said metal conduits, said dielectric and metal conduits cofunctioning to support said assembled sockets and tube and to position said tube in said letter housing substantially parallel to the center plane thereof.

* * * * *

UNITED STATES PATENT AND TRADEMARK OFFICE

CERTIFICATE OF CORRECTION

PATENT NO. : 4,460,226

DATED : July 17, 1984

INVENTOR(S) : Neil Hageman

It is certified that error appears in the above-identified patent and that said Letters Patent are hereby corrected as shown below:

Column 1, line 55, delete "constant" and insert ---contact---.

Column 2, line 22, delete "well" and insert ---wall---.

Column 2, line 48, delete "assemble" and insert ---assembly---.

Column 3, line 17, delete conducted" and insert ---outboard---.

Column 4, line 6, delete "it" and insert ---its---.

Signed and Sealed this

*Fourth* Day of *December 1984*

[SEAL]

*Attest:*

GERALD J. MOSSINGHOFF

*Attesting Officer*

*Commissioner of Patents and Trademarks*